US009771131B2

(12) United States Patent
Zijlmans et al.

(10) Patent No.: US 9,771,131 B2
(45) Date of Patent: Sep. 26, 2017

(54) VESSEL COMPRISING A MOON POOL AND A HOISTING ARRANGEMENT AND METHOD OF LOWERING ITEMS INTO THE SEA

(75) Inventors: Jurgen Arjan Zijlmans, Barendrecht (NL); Eline Wilhelmina Heerema, Den Haag (NL); Marius Peerdeman, Gorinchem (NL); Norbert Zandbergen, Berkel & Rodenrijs (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 497 days.

(21) Appl. No.: 14/113,906

(22) PCT Filed: Apr. 26, 2012

(86) PCT No.: PCT/EP2012/057574

§ 371 (c)(1),
(2), (4) Date: Jan. 21, 2014

(87) PCT Pub. No.: WO2012/146622

PCT Pub. Date: Nov. 1, 2012

(65) Prior Publication Data

US 2014/0161569 A1 Jun. 12, 2014

(30) Foreign Application Priority Data

Apr. 26, 2011 (NL) ..... 2006667

(51) Int. Cl.
*B63B 35/00* (2006.01)
*B63B 27/16* (2006.01)
(Continued)

(52) U.S. Cl.
CPC ..... *B63B 27/16* (2013.01); *B63B 35/4413* (2013.01); *E21B 19/00* (2013.01); *E21B 19/002* (2013.01)

(58) Field of Classification Search
CPC ..... B63B 27/16; B63B 35/4413; E21B 19/00; E21B 19/002
(Continued)

(56) References Cited

U.S. PATENT DOCUMENTS 2,308,743 A * 1/1943 Bulkley ..... E02B 17/021 175/9
3,894,640 A * 7/1975 Crooke ..... B63B 27/08 114/259
(Continued)

FOREIGN PATENT DOCUMENTS

WO 9911518 A1 3/1999
WO 2004020275 A2 3/2004
(Continued)

*Primary Examiner* — Anna Momper
*Assistant Examiner* — Lynn Schwenning
(74) *Attorney, Agent, or Firm* — Steven M. Koehler; Westman, Champlin & Koehler, P.A.

(57) ABSTRACT

A vessel for e.g. well intervention or deep sea lowering, comprises a moon pool and a hoisting arrangement for lowering and retrieving items, in particular equipment, tools, and/or supplies or modules comprising the same, through the moon pool, into respectively from the sea and onto respectively from the seabed or an installation on the seabed. The vessel further comprises one or more guides for laterally retaining items inside the moon pool, preferably at least two guides positioned on opposite sides of the moon pool.

13 Claims, 2 Drawing Sheets

(51) Int. Cl.
*B63B 35/44* (2006.01)
*E21B 19/00* (2006.01)

(58) Field of Classification Search
USPC ..... 414/142.8; 52/122.1, 123.1; 405/154.1, 405/158, 169, 170; 166/352, 356
See application file for complete search history.

(56) References Cited

U.S. PATENT DOCUMENTS 3,919,902 A * 11/1975 Johnson ..... E21B 19/155 173/164
3,919,958 A * 11/1975 Graham ..... B63B 35/4413 114/264
3,981,369 A * 9/1976 Bokenkamp ..... E21B 19/14 166/352
4,165,706 A * 8/1979 Parsons ..... B63C 11/34 114/258
4,232,903 A * 11/1980 Welling ..... E02F 3/8858 241/1
4,350,014 A * 9/1982 Sanchez ..... B63B 35/44 114/264
4,652,177 A * 3/1987 Gunther, Jr. ..... E02B 17/08 212/253
5,188,484 A * 2/1993 White ..... E02B 17/021 405/198
6,217,258 B1 * 4/2001 Yamamoto ..... E21B 15/02 175/5
6,871,609 B2 * 3/2005 Roodenburg ..... B63B 15/00 114/201 R
2004/0089215 A1 5/2004 Roodenburg et al.
2005/0051072 A1 3/2005 Roodenburg et al.
2009/0151955 A1 6/2009 Bamford
2011/0139056 A1 * 6/2011 Cholley ..... B63B 27/04 114/264
2012/0128434 A1 * 5/2012 Shafer ..... E02B 17/0021 405/217

FOREIGN PATENT DOCUMENTS

WO 2006123147 A1 11/2006
WO 2007027081 A1 3/2007
WO 2011008835 A2 1/2011

* cited by examiner

VESSEL COMPRISING A MOON POOL AND A HOISTING ARRANGEMENT AND METHOD OF LOWERING ITEMS INTO THE SEA

CROSS-REFERENCE TO RELATED APPLICATION

The present application is a Section 371 National Stage Application of International patent application Serial No. PCT/EP2012/057574, filed Apr. 26, 2012, and published as WO 2012/146622 A1 in English.

BACKGROUND

The discussion below is merely provided for general background information and is not intended to be used as an aid in determining the scope of the claimed subject matter.

Aspects of the invention relate to a vessel for e.g. well intervention or deep sea lowering, comprising a moon pool and a hoisting arrangement for lowering and retrieving items, in particular equipment, tools, and/or supplies or modules comprising the same, through the moon pool, into respectively from the sea and onto respectively from the seabed or an installation already present on the seabed. Aspects of the invention further relate to a handling system to be installed on such a vessel and to a method of lowering or retrieving items into respectively from the sea.

SUMMARY

This Summary and Abstract are provided to introduce some concepts in a simplified form that are further described below in the Detailed Description. This Summary and Abstract are not intended to identify key features or essential features of the claimed subject matter, nor are they intended to be used as an aid in determining the scope of the claimed subject matter. In addition, the description herein provided and the claimed subject matter should not be interpreted as being directed to addressing any of the short-comings discussed in the Background.

A vessel includes one or more guides for laterally retaining items inside the moon pool, preferably at least two guides positioned on opposite sides or corners of the moon pool, e.g. a guide at each corner of the moon pool.

The guides suppress or, depending on the configuration, even prevent horizontal movement, i.e. movement in the X- and Y-directions (vertical movement defining the Z-direction), of the items relative to the vessel, in particular the walls of the moon pool, thus providing a more controlled lowering and retrieval of the items and avoiding collision of the items with said walls.

In an embodiment, the guides extend at least partially in the moon pool and/or are provided at different heights in the moon pool, in particular both in the upper half, e.g. at or near the top, and in the lower half, e.g. at or near the bottom, of the moon pool, effectively providing guidance over a greater length. It is preferred that the effective length of the guides is in excess of half the height of the moon pool.

Another embodiment comprises a drive mechanism, e.g. one or more hydraulic cylinders, jacks or toothed racks and driven pinions, for retaining the items in the vertical direction and for exerting (directly or indirectly) a downward or upward force on the items.

Thus, the items, while being positively guided inside the moon pool and between the guides, can be pushed through the so-called splash-zone, i.e. the surface of the water, in a controlled manner, avoiding heave of the items relative to the vessel.

In another embodiment, the vessel comprises a tower for supporting and/or receiving one or more of the items, which tower is translatingly mounted between the guides and coupled to the drive mechanism, if present.

In a further embodiment, the tower comprises fasteners, e.g. grippers, to temporarily hold a plurality of items, one stacked above the other.

The tower provides an effective means for stacking separate modules and lowering, e.g. pushing, or retrieving, e.g. pulling, them in a controlled manner through the splash-zone.

Further, the tower preferably replaces the conventional tower that is usually positioned next to the moon pool, thus providing more space on deck next to the moon pool and facilitating efficient storage and handling of the items to be lowered into the sea. Also, a tower positioned and lowered into the moon pool, e.g. such that the bottom of the tower is flush with the hull of the vessel, will have a lesser height than conventional towers, which in turn enables passing bridges that are too low for conventional towers and, in a more specific application, facilitates fitting a cover over the tower e.g. to protect it from extreme cold and wind.

In an embodiment, the tower comprises doors in its bottom end. The doors enable closing the bottom end of the moon pool during transit, thus improving safety and increasing (fuel) efficiency.

In another embodiment the tower comprises a plurality of guide wires, preferably attached to the tower at or near its bottom end.

The invention further relates to a handling system to be installed on a vessel as described above comprising one or more guides for laterally retaining items inside the moon pool and a tower for supporting and/or receiving one or more of the items, which tower is translatingly mountable between the guides.

In an embodiment, the system comprises a drive mechanism for exerting a downward or upward force on the tower and thus indirectly on the items.

The invention further relates to a method of lowering and retrieving items, in particular equipment, tools, and/or supplies or modules comprising the same into respectively from the sea and onto respectively from the seabed or an installation on the seabed by means of a vessel as described above comprising a moon pool and a hoisting arrangement, the method comprising the steps of suspending one or more items from the hoisting arrangement, lowering or hoisting the items through the moon pool, laterally retaining the items while they are being lowered or hoisted through the moon pool, preferably between at least two guides positioned on opposite sides or corners of the moon pool.

In another embodiment, the method comprises the steps of loading the items to be lowered onto and/or into a tower and translatingly lowering the tower between the guides, e.g. loading a first item onto and/or into the tower, lowering or hoisting the tower and loading a second item onto and/or into the tower, respectively above or below the first item.

In an embodiment, the method comprises exerting a downward or upward force on the items being lowered or hoisted trough the moon pool. The force can be exerted directly on the items or indirectly, e.g. via the tower.

Within the framework of the present invention the term "moon pool" is defined as any opening in the hull through which items, in particular equipment, tools, and/or supplies or modules comprising the same, can be lowered into or retrieved from the sea, in particular openings that extend all the way up to the deck of the vessel enabling items to be stored and handled on deck and lowered directly from the deck into the sea.

BRIEF DESCRIPTION OF THE DRAWINGS

Aspects of the invention will now be explained in more detail with reference to the drawings, which schematically show embodiments of the vessel and method of the present invention.

DETAILED DESCRIPTION OF THE ILLUSTRATIVE EMBODIMENTS

Figure 1A:
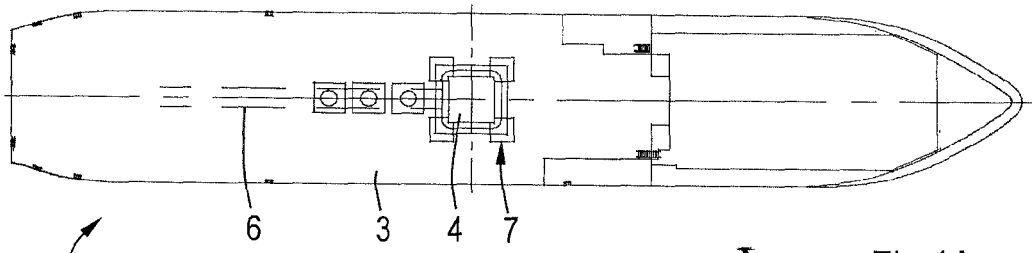
FIGS. 1A and 1B are top and side views of a well intervention vessel comprising a translating tower.

FIGS. 1A to 3 show a well intervention vessel 1 comprising a hull 2, a deck 3, and a moon pool 4 extending through the deck and the hull. A plurality of items 5, in particular equipment, tools, and/or supplies or modules comprising the same, are placed on deck, more specifically on the so-called firing-line 6, i.e. lined up with the moon pool 4.

Figure 1B:
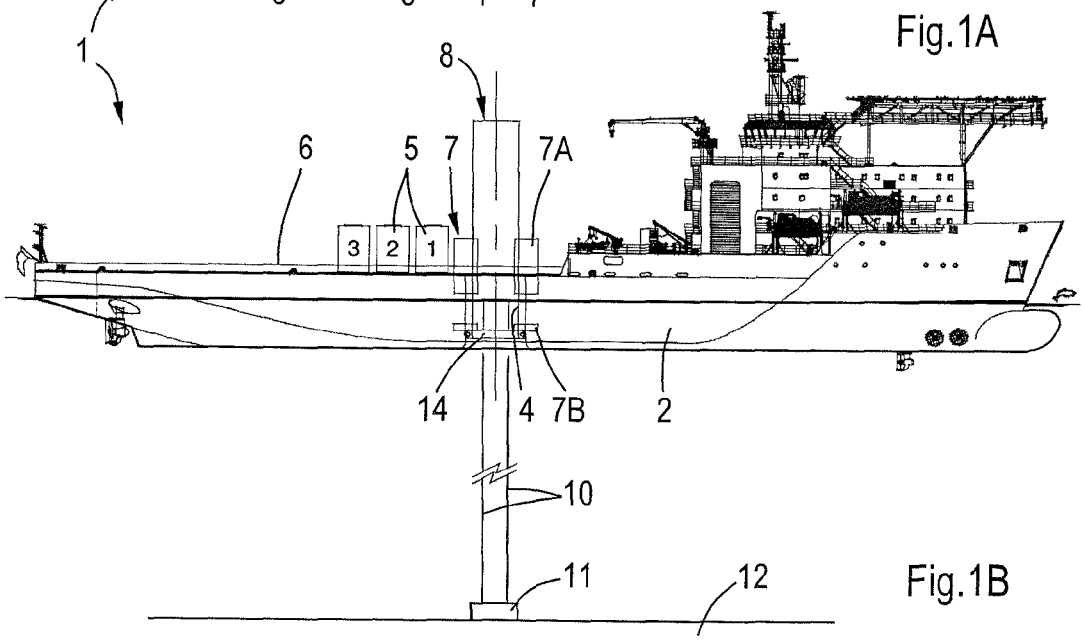
Figure 2:
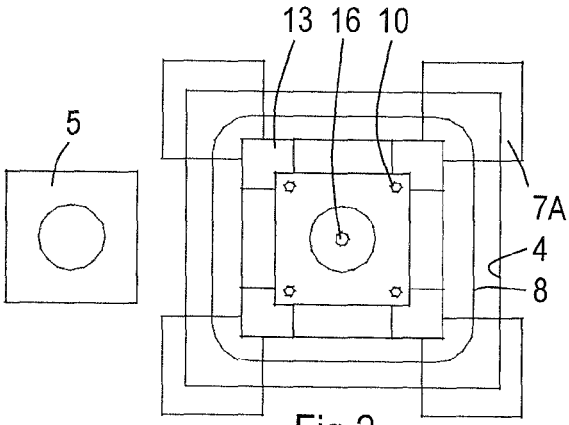
FIG. 2 is a detail of the vessel shown in FIG. 1A.
Figure 3:
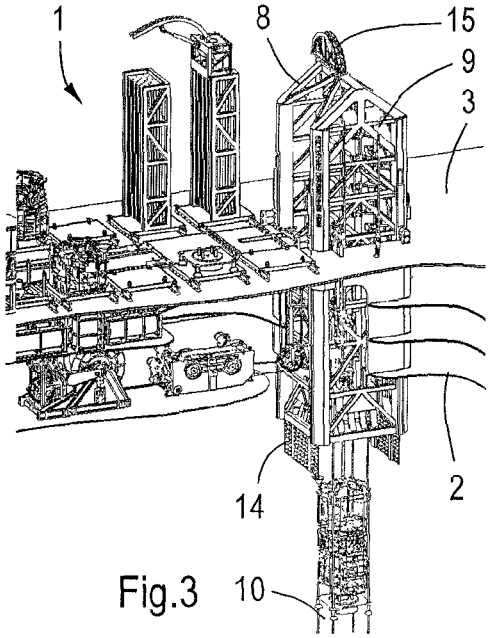
FIG. 3 is a perspective view of a translating tower.

As shown in FIG. 1B, a plurality of guides 7, in this example four guides, are positioned in the moon pool 4, one in each corner of the moon pool 4. Each guide comprises two parts, a top part 7A mounted on deck 3 and partially extending into the moon pool 4 and a bottom part 7B near the bottom side of the hull, together providing effective guidance over a length of approximately 80% of the height of the moon pool 4.

A tower 8 for supporting and/or receiving one or more of the items is translatingly mounted between the guides 7. In this example, the tower 8 is provided at each corner with a vertical toothed rack (not shown) and each of the upper parts 7A of the guides 7 contains a pinion and a motor for driving the pinion and thus positively translating the tower up 8 and down.

Further, the tower 8 comprises four winches 9 for an equal number of guide cables 10, known in themselves, that, once deployed, extend from the tower 8 to a well 11 (FIG. 1B) on the seabed 12 below. In the example shown in FIG. 3, the winches 7 for the guide cables 10 are located near the top of the tower 8.

The tower 8 is open on the side facing the firing line 6, to allow items 5 to be entered into the tower 8. In this example, the tower 8 has a U-shaped cross-section over the greater part of its length. The tower 8 comprises grippers 13 (FIG. 2), to temporarily hold a plurality of items, one stacked above the other. In its bottom end, the tower 8 comprises a pair doors 14 closing the bottom end of the moon pool 4 during transit.

A main hoisting arrangement 15 comprising e.g. a hoist cable 16, a winch and a motor is provided on or below deck, next to or at some distance of the tower 8.

The tower 8 provides an effective means for stacking separate modules and 'pushing' the assembled stack in a controlled manner through the splash-zone, as follows.

Figure 4A:
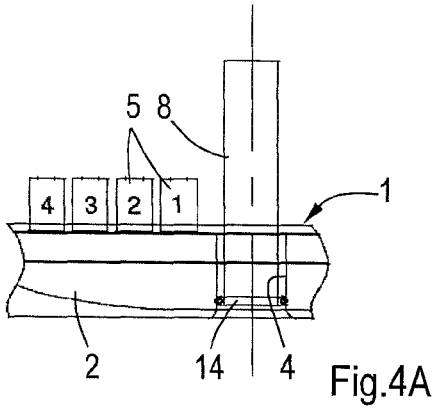
FIGS. 4A to 4G illustrate an example of the method of stacking items in a tower and lowering the items.
Figure 4B:
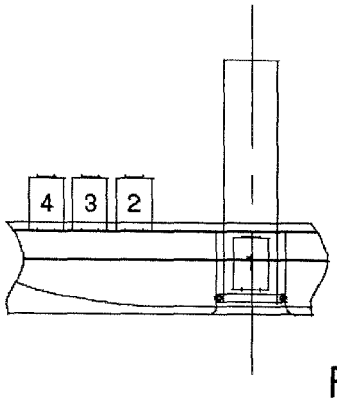
Figure 4C:
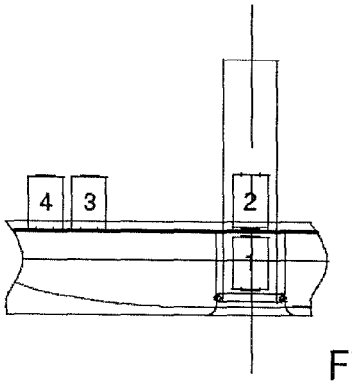

FIGS. 4A to 4G illustrate a method of lowering a one or more e.g. four modules 5 onto a well 11 on the seabed 12 by means of the vessel 1 described above. During transit, the lower part of the tower 8 is in inside the moon pool 4, such that the (closed) doors 14 in the bottom of the tower 8 are flush with the hull 2. The four modules 5 identified as "1", "2", "3" and "4" are stored on deck, in this example lined up on the firing line 6 (FIG. 4A).

Figure 4D:
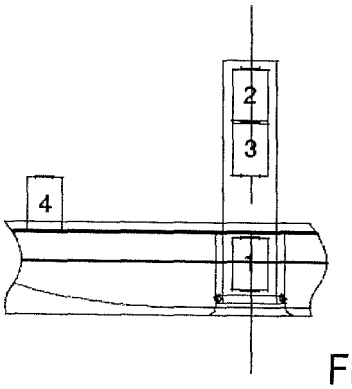
Figure 4E:
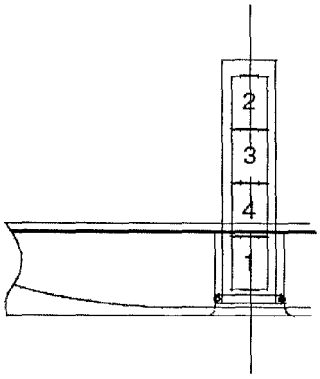

Once the vessel 1 is positioned over the well 11 and the guide lines for lowering the modules are in place, the tower 8 is translated to its uppermost position, the first module "1" is loaded and secured in the tower 8, and the tower 8 is lowered to its initial position, thus maintaining a relatively low center of gravity. Next, the second module "2" is loaded in the tower (FIG. 4C), connected to the main hoist cable 16 and hoisted to allow the third module "3" to be loaded into the tower 8, beneath the second module "2". After the third module "3" is connected to the second module "2" the (sub)stack thus obtained is hoisted to allow the fourth module "4" to be loaded into the tower 8, beneath the third module "3" (FIG. 4D).

Figure 4F:
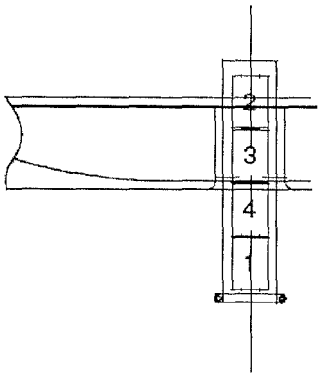
Figure 4G:
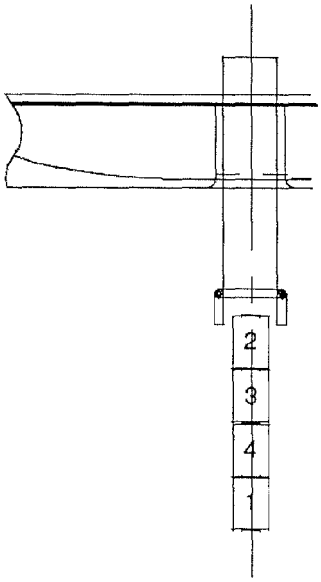

After completing the stack of four modules by connecting the fourth module "4" to the first and third modules "1", "3" (FIG. 4E), the tower 8 containing the stack is gradually lowered through the moon pool 4, while laterally retaining the modules 8 and positively avoiding any contact between the modules and the walls of the moon pool 4 (FIG. 4F). When the tower 8 reaches it lowermost position or at least a lower position wherein the doors 14 clear the hull by a sufficient distance, the doors 14 are opened, the grippers 13 are released from the stack and the stack is lowered from the tower 8 and along the guide wires to the well 11 below, again while preventing any contact between the modules and the moon pool 4. Further, the items, while being positively guided inside the moon pool 4 and between the guides 7, are forced through the so-called splash-zone, i.e. the surface of the water, in a controlled manner.

The invention is not restricted to the above-described embodiments which can be varied in a number of ways within the scope of the claims. For instance, during retrieving items from the sea, the uppermost module could be removed first, followed by the one below that, and so on, thus continually maintaining the center of gravity as low as possible.

What is claimed is:

1. A vessel comprising a moon pool and a hoisting arrangement configured to lower items, through the moon pool, into a sea and onto a seabed or an installation on the seabed and configured to retrieve items, through the moon pool, from the sea, the seabed, or an installation on the seabed, wherein the vessel comprises a tower configured to receive one or more items, and one or more guides configured to laterally retain the tower inside the moon pool, wherein the tower is translatingly mounted between the guides for moving up and down and comprises an open side configured to allow items to be entered into the tower, wherein the tower comprises at least two connected walls defining an open side vertical channel extending therethrough and including the open side, and wherein the vessel has a deck next to the moon pool and is configured such that items can be transferred between the tower and the deck through the open side of the open side vertical channel.

2. The vessel according to claim 1, wherein the guides extend at least partially in the moon pool.

3. The vessel according to claim 2, wherein the guides are provided at different heights in the moon pool.

4. The vessel according to claim 1, wherein the tower comprises fasteners configured to temporarily hold a plurality of items, one item stacked above another item.

5. The vessel according to claim 1, wherein the tower comprises doors at a lower end thereof.

6. The vessel according to claim 1, wherein the tower comprises a plurality of guide wires extending within the tower.

7. The vessel according to claim 1 and further comprising at least two guides positioned on opposite sides or corners of the moon pool.

8. The vessel according to claim 1, wherein the guides are provided at different heights in the moon pool.

9. A handling system configured to be installed on a vessel to handle items, the handling system comprising a moon pool and a hoisting arrangement configured to lower and retrieve items, through the moon pool, wherein a tower is configured to receive one or more items, and one or more guides are configured to laterally retain the tower inside the moon pool, which tower is translatingly mountable between the guides enabling the tower to be moved up and down and comprises an open side configured to allow items to be entered into the tower, wherein the tower comprises at least two connected walls defining an open side vertical channel extending therethrough and including the open side, and wherein the vessel has a deck next to the moon pool and is configured such that items can be transferred between the tower and the deck through the open side of the open side vertical channel.

10. A method of lowering or retrieving items into a sea and onto a seabed or an installation on the seabed by a vessel using a moon pool and a hoisting arrangement, the method comprising:

suspending one or more items from the hoisting arrangement, lowering or hoisting the items through the moon pool, laterally retaining the items while the items are being lowered or hoisted through the moon pool, and loading the items into a tower having an open side to allow items to be entered into the tower and translatingly lowering or hoisting the tower between guides which retain the tower inside the moon pool, wherein the tower comprises at least two connected walls defining an open side vertical channel extending therethrough and including the open side, and wherein the vessel has a deck next to the moon pool, and further comprising transferring items between the tower and the deck through the open side of the open side vertical cannel.

11. The method according to claim 10, and further comprising loading a first item into the tower, lowering or hoisting the tower and loading a second item into the tower, respectively above or below the first item.

12. The method according to claim 11, and further comprising connecting an uppermost item to the hoisting arrangement.

13. The method according to claim 10 wherein laterally retaining the tower while the tower is being lowered or hoisted through the moon pool includes guiding the tower using at least two guides positioned on opposite sides or corners of the moon pool.

* * * * *